US008371807B2

(12) United States Patent
Bigi et al.

(10) Patent No.: US 8,371,807 B2
(45) Date of Patent: Feb. 12, 2013

(54) PROTECTION DEVICE FOR A TURBINE STATOR

(75) Inventors: Manuele Bigi, Calenzano (IT); Piero Iacopetti, Uzzano (IT); Vincenzo Branchetti, Florence (IT)

(73) Assignee: Nuovo Pignone, S.p.A., Florence (IT)

( * ) Notice: Subject to any disclaimer, the term of this patent is extended or adjusted under 35 U.S.C. 154(b) by 877 days.

(21) Appl. No.: 11/575,423

(22) PCT Filed: Sep. 13, 2005

(86) PCT No.: PCT/EP2005/009887

§ 371 (c)(1),
(2), (4) Date: Mar. 16, 2007

(87) PCT Pub. No.: WO2006/029844

PCT Pub. Date: Mar. 23, 2006

(65) Prior Publication Data

US 2009/0180863 A1 Jul. 16, 2009

(30) Foreign Application Priority Data

Sep. 17, 2004 (IT) ..... MI2004A1781

(51) Int. Cl.
*F01D 11/24* (2006.01)

(52) U.S. Cl. ..... 415/173.2

(58) Field of Classification Search ..... 415/47, 415/126, 127, 128, 139, 173.2, 173.3
See application file for complete search history.

(56) References Cited

U.S. PATENT DOCUMENTS

| | | | | |
|---|---|---|---|---|
| 3,860,358 | A * | 1/1975 | Cavicchi et al. | 415/173.1 |
| 4,551,064 | A * | 11/1985 | Pask | 415/116 |
| 4,784,569 | A | 11/1988 | Sidenstick et al. | |
| 5,380,150 | A * | 1/1995 | Stahl | 415/139 |
| 6,361,273 | B1 * | 3/2002 | Eng et al. | 415/173.1 |
| 6,602,048 | B2 * | 8/2003 | Fujikawa et al. | 415/116 |
| 7,559,740 | B2 * | 7/2009 | Bigi et al. | 415/136 |
| 2002/0150469 | A1 | 10/2002 | Bolms | |

FOREIGN PATENT DOCUMENTS

| | | | |
|---|---|---|---|
| EP | 1162346 | A2 | 12/2001 |
| EP | 1 225 305 | A | 7/2002 |
| EP | 1243756 | A1 | 9/2002 |
| JP | 62-195402 | A | 8/1987 |
| JP | 2002-349210 | A | 12/2002 |

OTHER PUBLICATIONS 2007-531666, Japanese Office Action, Dec. 21, 2010.

KR Office Action dated Jun. 28, 2012 from corresponding KR Application No. 7008603 unofficial English translation.

* cited by examiner

*Primary Examiner* — Richard Edgar
(74) *Attorney, Agent, or Firm* — GE Global Patent Operation

(57) ABSTRACT

Protection device for a stator of a turbine of the type comprising a series of annular sectors constrained to each other by means of connection means, each sector of the series of sectors comprises a first surface, suitable for contacting the stator which has at least one cavity for the cooling of the corresponding sector, and a second surface which faces a rotor of the turbine. In a rest configuration in which the turbine is not operating, the second surface of each sector has an axial section having an eccentricity with respect to the trace of the rotation axis of the turbine, whereas in an operating configuration in which the turbine is operating under regime conditions, the second surface of each sector has an axial section which is centered with the trace of the rotation axis of the turbine.

5 Claims, 1 Drawing Sheet

PROTECTION DEVICE FOR A TURBINE STATOR

The present invention relates to a protection device for a turbine stator.

A gas turbine is a rotating thermal machine which converts the enthalpy of a gas into useful work, using gases coming from a combustion and which supplies mechanical power on a rotating shaft.

The turbine therefore normally comprises a compressor or turbo-compressor, inside which the air taken from the outside is brought under pressure.

Various injectors feed the fuel which is mixed with the air to form a air-fuel ignition mixture.

The axial compressor is entrained by a so-called turbine, or turbo-expander, which supplies mechanical energy to a user transforming the enthalpy of the gases combusted in the combustion chamber.

In applications for the generation of mechanical energy, the expansion jump is subdivided into two partial jumps, each of which takes place inside a turbine. The high-pressure turbine, downstream of the combustion chamber, entrains the compression. The low-pressure turbine, which collects the gases coming from the high-pressure turbine, is then connected to a user.

The turbo-expander, turbo-compressor, combustion chamber (or heater), outlet shaft, regulation system and ignition system, form the essential parts of a gas turbine plant.

As far as the functioning of a gas turbine is concerned, it is known that the fluid penetrates the compressor through a series of inlet ducts.

In these canalizations, the gas has low-pressure and low-temperature characteristics, whereas, as it passes through the compressor, the gas is compressed and its temperature increases.

It then penetrates into the combustion (or heating) chamber, where it undergoes a further significant increase in temperature.

The heat necessary for the temperature increase of the gas is supplied by the combustion of gas fuel introduced into the heating chamber, by means of injectors.

The triggering of the combustion, when the machine is activated, is obtained by means of sparking plugs.

At the outlet of the combustion chamber, the high-pressure and high-temperature gas reaches the turbine, through specific ducts, where it gives up part of the energy accumulated in the compressor and heating chamber (combustor) and then flows outside by means of the discharge channels.

In the inside of a turbine there is a stator, equipped with a series of stator blades in which a rotor, also equipped with a series of blades (rotor), is housed and is capable of rotating, said stator being rotated as a result of the gas.

The protection device, also known as "shroud", together with the platform of stator blades, defines the main gas flow.

The function of the shroud is to protect the outer cases, which are normally made of low-quality materials and therefore have a low resistance to corrosion, from oxidation and deterioration.

The shroud generally consists of a whole ring, or is suitably divided into a series of sectors, each of which is cooled with a stream of air coming from a compressor.

The cooling can be effected with various techniques which essentially depend on the combustion temperature and temperature decrease to be obtained.

The type of protection device to which the present invention relates comprises a series of sectors, assembled to form a ring, each of which has a cavity situated on the outer surface of each sector.

In the case of machines with a high combustion temperature, the most widely used cooling technique is that known as "impingement".

According to this technique, a sheet is fixed, preferably by means of brazing, on each cavity of each sector, a sheet equipped with a series of pass-through holes through which fresh air coming from a compressor is drawn for the cooling of the shroud itself, in particular by the impact of said air on the bottom surface of said cavity and its subsequent discharge from a series of outlet holes situated in each sector, not shown in the figures.

In spite of these expedients, even if an efficient cooling is effected, the shroud and therefore also each of its sectors, is subject to deformation due to thermal gradients and to the operating temperature of the turbine which create a deformed configuration different from that at room temperature, i.e. with respect to a rest configuration in which the turbine is not operating.

As a result of the thermal gradients, a non-uniform deformation of the shroud is created.

A first disadvantage is that this reduces the useful life of the component as there is the possible danger, with deformation, of there being friction between the rotor blades and the shroud.

Another disadvantage is that by increasing the clearances, there is a drawing of air through the stator which in turn causes a loss in efficiency or however in the performances of the turbine.

An objective of the present invention is to provide a protection device for a turbine stator which allows the clearances between the rotor and the turbine stator to be reduced.

A further objective is to provide a protection device for a turbine stator which increases the yield and power of the turbine itself, also avoiding the danger of friction between the rotor blades and the protection device itself.

Another objective is to provide a protection device for a turbine stator which has a greater dimensional stability when operating.

Yet another objective is to provide a protection device for a turbine stator which is simple and economical.

These objectives according to the present invention are achieved by providing a protection device of a stator of a gas turbine.

The characteristics and advantages of a protection device of a stator of a gas turbine according to the present invention will appear more evident from the following illustrative and non-limiting description, referring to the schematic drawings enclosed, in which.

Figure 2:
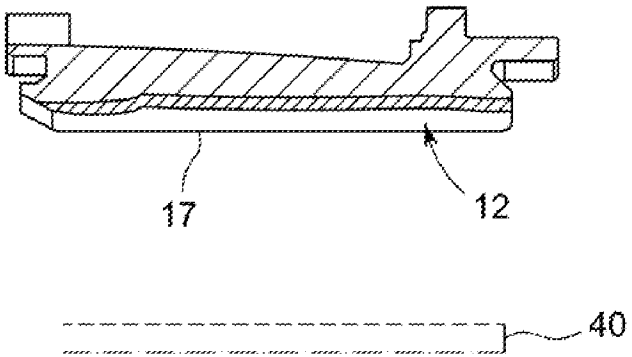
FIG. 2 is a raised transversal view of the sector of FIG. 1 in a rest configuration.
Figure 1:
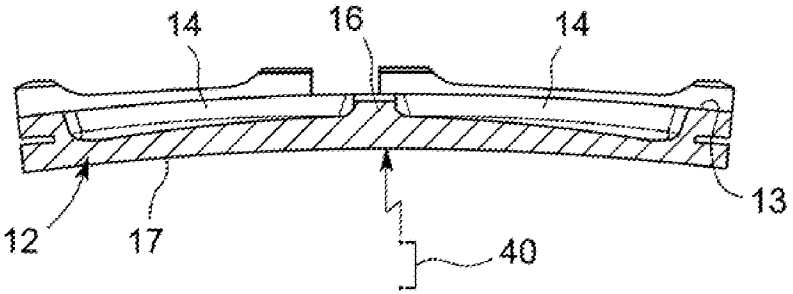
FIG. 1 is a raised sectional view of a preferred embodiment of a sector of a protection device according to the present invention in a rest configuration.

With reference to the figures, these show a protection device 10 for a stator of a turbine of the type comprising a series of sectors 12, each of which is equipped with fixing means for the assembly with the sectors of said series of sectors 12.

According to the present invention, each sector 12 has an annular-shaped sector and comprises a first surface 13 which in turn has at least one cavity 14 divided by a rib 16, and a second surface 17, opposite the first surface 13, which faces a rotor also situated inside a turbine.

Said second surface, 17 together with the second surfaces 17 of the series of sectors 12, defines an internal rotation surface.

Each sector 12 passes from a rest configuration, in which the turbine is not operating, to an operating configuration in which it is deformed due to the thermal gradients which are created inside the turbine itself.

In the rest configuration, each sector 12 and consequently also the protection device 10 is not deformed as it is at room temperature, preferably approximately 25° C.

In the operating configuration, on the other hand, each sector 12 and therefore also the protection device 10, is deformed by the thermal gradients, i.e. it is in a deformed configuration within a temperature range preferably of 400 to 1100° C.

In a rest configuration, said second surface 17 of each sector 12 has a transversal section having an eccentricity 40 with respect to the axis of the turbine, i.e. a shift between the center of said transversal section and the trace of the axis of the turbine.

In other words, each sector 12 and therefore also the series of sectors 12 of the protection device has an internal rotation surface 17 which, in a non-deformed configuration (rest), is eccentric with respect to the axis of the turbine and, in a deformed configuration (with the turbine operating at a high temperature), is coaxial with the axis of the turbine.

In other words, in a deformed or operating configuration, said protection device 10 of a turbine rotor has an internal surface which faces the relative turbine rotor, having an eccentricity approximately null with respect to the rotation axis of the turbine itself.

In this way, it is possible to obtain minimum clearances and therefore minimize the losses due to the drawing of air through the protection device 10.

Consequently, by having a protection device 10 or shroud which, within the range of operating temperatures of the turbine, has a deformed configuration coaxial with the axis of the turbine, a greater yield and power of the turbine is obtained, also avoiding the danger of possible friction between the protection device 10 of the stator and the rotor blades.

In a rest configuration in which the turbine is not operating, i.e. at a room temperature of 25° C., the protection device 10 preferably has an eccentricity 40, i.e. a shift between the rotation centre of the turbine and the centre of a transversal section of the shroud, which in an adimensionalized absolute value with respect to the radius of the turbine rotor, ranges from 0.253 to 0.086 mm.

Said adimensionalized eccentricity 40 with respect to the radius of the rotor, i.e. divided by the radius of the turbine rotor, ranges from 0.14 to 0.20.

Said eccentricity 40 is preferably 0.17.

The reason for this is that, in the range of operating temperatures of the turbine, the protection device 10, due to the non-uniformity of the thermal gradients inside the turbine itself, is subject both to radial and axial deformation.

According to a preferred embodiment of the present invention, a protection device for a turbine stator is provided, which, in an operating configuration, i.e. in a range of operating temperatures of the turbine, has a deformed configuration which is coaxial with the axis of the turbine, and which preferably has an internal rotation surface 17 which is cylindrical.

In this way, each sector 12, in the operating temperature range, is axially aligned with the rotation axis of the turbine, as well as having a second internal surface 17 coaxial with the axis of the turbine itself.

By avoiding or in any case reducing to the minimum the risk of possible friction between the shroud and the blades with which the rotor is equipped, an increase in the useful life of the device itself is advantageously obtained, consequently also reducing the times and costs for the maintenance of the relative turbine.

It is therefore evident that, according to the present invention, by means of a protection device having an internal rotation surface which is eccentric with respect to the rotation axis of the turbine in a rest configuration, it is possible to have, in an operating configuration, during the functioning of the turbine, a protection device which is perfectly coaxial and centered with the axis of the turbine itself, achieving both individually or advantageously contemporaneously the objectives of the present invention.

The protection device for a turbine stator of the present invention thus conceived can undergo numerous modifications and variants, all included in the same inventive concept.

Furthermore, in practice, the materials used, as also the dimensions and components, can vary according to technical demands.

What is claimed is:

1. A protection device for a stator of a turbine comprising:

a series of annular sectors constrained to each other by a connector, each sector of said series of sectors comprises a first surface, suitable for contacting said stator which has at least one cavity for the cooling of the corresponding sector; and a second surface which faces a rotor of the turbine, wherein in a rest configuration in which the turbine is not operating, said second surface of each sector has an axial section having an eccentricity with respect to a trace of a rotation axis of said turbine to provide a radial clearance in both an axial and a circumferential direction with respect to the trace of the rotation axis of said turbine; and wherein in an operating configuration in which said turbine is operating under regime conditions, in which the turbine is affected by non-uniform thermal gradients, said second surface of each sector is configured to deform, based on the non-uniform thermal gradients, in each of the axial and circumferential directions such that an axial section is centered with the trace of the rotation axis of said turbine;

wherein due to the axial deformation, a loss of air between the protection device and a rotor blade is minimized in the axial direction.

2. The protection device according to claim 1, wherein said adimensionalized eccentricity with respect to the radius of the rotor ranges from 0.253 to 0.086.

3. The protection device according to claim 2, wherein said eccentricity divided by the radius of the rotor has a value ranging from 0.14 to 0.20.

4. The protection device according to claim 2, wherein said eccentricity divided by the radius of the rotor is 0.17.

5. The protection device according to claim 1, wherein said series of sectors comprises a stiffening rib situated inside at least one cavity.

* * * * *